United States Patent [19]

Brown

[11] Patent Number: 4,986,783

[45] Date of Patent: Jan. 22, 1991

[54] OUTBOARD MOTOR POWER TAKEOFF

[76] Inventor: Oswald Brown, P.O. Box 127, 14 Parkwood Dr., Hare Bay, Bonavista Newfoundland, A0G 2P0, Canada, A0G 2P0

[21] Appl. No.: 317,926

[22] Filed: Mar. 2, 1989

[51] Int. Cl.[5] ..... B63H 21/38

[52] U.S. Cl. ..... 440/900; 440/88; 60/431

[58] Field of Search ..... 440/5, 76, 61, 77, 88, 440/900, 43; 114/218, 181, 221 R, 253, 254, 268; 254/270, 272, 273, 374, 371, 361, 328; 242/190; 226/43, 42; 60/431; 43/8; 417/34, 38, 44, 313; 123/319, 195 P

[56] References Cited

U.S. PATENT DOCUMENTS

| | | | |
|---|---|---|---|
| 2,351,050 | 6/1944 | Karey | 440/88 |
| 3,057,162 | 10/1962 | Lee | 254/273 |
| 3,797,967 | 3/1974 | Howeth | 417/34 |
| 4,300,872 | 11/1981 | Brown et al. | 440/76 X |
| 4,580,766 | 4/1986 | Woodgate | 254/371 |
| 4,588,385 | 5/1986 | Suzuki et al. | 440/88 |
| 4,650,430 | 3/1987 | Schiek | 440/88 |
| 4,698,035 | 10/1987 | Ferguson | 440/84 X |
| 4,820,212 | 4/1989 | McElroy et al. | 440/88 |

FOREIGN PATENT DOCUMENTS

| | | | |
|---|---|---|---|
| 2544090 | 4/1976 | Fed. Rep. of Germany | 440/88 |
| 2447144 | 9/1980 | France | 43/8 |

*Primary Examiner*—Joseph F. Peters, Jr.
*Assistant Examiner*—Edwin L. Swinehart
*Attorney, Agent, or Firm*—Fetherstonhaugh & Co.

[57] ABSTRACT

An outboard motor assembly includes a hydraulic pump which is carried by the motor assembly and is drivingly connected to the main drive shaft at a point located between the motor and the propeller shaft. The hydraulic fluid storage container is carried by the housing assembly of the motor. Hydraulic fluid couplings are provided for connecting the hydraulic pump to a hydraulically driven device which is remote from the outboard motor assembly. The couplings are carried by the motor assembly and comprise an output coupling member and a return coupling member. The output coupling member communicates with the pump and the return coupling member communicates with the fluid storage chamber. The outboard motor assembly is suitable for use in association with a winch which is adapted to be mounted on a boat. The winch includes a hydraulic motor which is drivingly connected to the hydraulic pump. The winch also includes a sheave which has a circumferentially extending line hauling groove which extends in a generally serpentine path which serves to reduce slippage during hauling.

12 Claims, 10 Drawing Sheets

OUTBOARD MOTOR POWER TAKEOFF

BACKGROUND OF THE INVENTION

This invention relates to outboard motors which have a power takeoff.

In addition, this invention relates to fishing boats which are powered by outboard motors which also serve to power hydraulically operated devices which are remote from the outboard motor.

Outboard motors which are designed to drive both a propeller and an auxiliary service pump are known. One such device is illustrated in U.S. Pat. No. 2,610,602. In this device, the auxiliary service pump is mounted on the exterior of the pump housing and is driven by a belt which is connected to a drum which is driven by the shaft of the engine. It is difficult to modify an outboard motor to employ this type of additional service pump while continuing to use the conventional motor cover which is usually provided. As a result, it will be necessary to completely redesign the engine cover when an engine is modified to include this auxiliary pump.

U.S. Pat. No. 4,698,035 discloses a structure in which the pump assembly is removably mounted on the side of the engine block and again, the pump is driven by a belt and pulley system from the upper end of the engine block. This would also require that the upper cover of the housing be redesigned in order to accommodate the pump. This also adds additional bulk to the upper end of the engine. In addition, the storage reservoir which is incorporated into the pump housing which is also located within the confines of the cover must be relatively small. While a large capacity reservoir is not required when the power system is to be used to control the operation of the power steering system of the engine, this reservoir would be quite inadequate for any other application in which a substantial volume of hydraulic fluid must be circulated to a remote work site.

U.S. Pat. No. 3,108,096 discloses a fluid pressure activating system for use in the power steering system of an outboard motor which includes a pump which is driven by the outboard motor. In this device, the pump is a diaphragm pump which is driven from the upper end of the main crank shaft of the outboard motor. It is not driven from the portion of the drive shaft which extends between the motor and the propeller shaft. As a consequence, it must be accommodated within the motor cover and this means that it would be necessary to enlarge the cover in order to accommodate this structure.

U.S. Pat. No. 4,300,872 also discloses a pump which is driven by the upper end of the output shaft of the motor which also requires modification to the existing engine cover.

SUMMARY OF INVENTION

It is an object of the present invention to provide an auxiliary hydraulic pump in an outboard motor assembly which is driven by the portion of the main drive shaft which extends from the motor to the propeller shaft.

According to one aspect of the present invention, there is provided in an outboard motor assembly of the type having a housing assembly which accomodates a motor, a propeller shaft and a power transmission system which includes main drive shaft which has a major portion of its length which extends between and drivingly connects the motor to the propeller shaft, the improvement wherein the outboard motor assembly further comprises a hydraulic pump carried by the motor assembly and drivingly connected to the major portion of the main drive shaft so as to be operable to pump hydraulic fluid when the motor is running, hydraulic fluid storage means carried by said housing assembly and having a fluid storage chamber formed therein, hydraulic fluid coupling means for connecting the hydraulic pump to an hydraulically driven device which is remote from said outboard motor assembly, said coupling means being carried by said motor assembly and comprising; an output coupling member and a return coupling member, said output coupling member communicating with said pump to receive hydraulic fluid from said pump, said return coupling member communicating with said fluid storage chamber to return fluid to said storage chamber.

According to a further aspect of the present invention there is provided in a fishing boat which is powered by an outboard motor assembly which is mounted on the boat and which includes a motor which is operable to propel the boat, the improvement of a hydraulic pump carried by the motor assembly and drivingly connected to the motor, a winch mounted on the boat at a point remote from the motor, an hydraulic motor drivingly connected to said winch and operably connected to said hydraulic pump such that the winch may be driven by the motor of the outboard motor assembly.

BRIEF DESCRIPTION OF THE DRAWINGS

The invention will be more clearly understood after reference to the following detailed specification read in conjunction with the drawings wherein.

DESCRIPTION OF PREFERRED EMBODIMENTS

Figure 1:
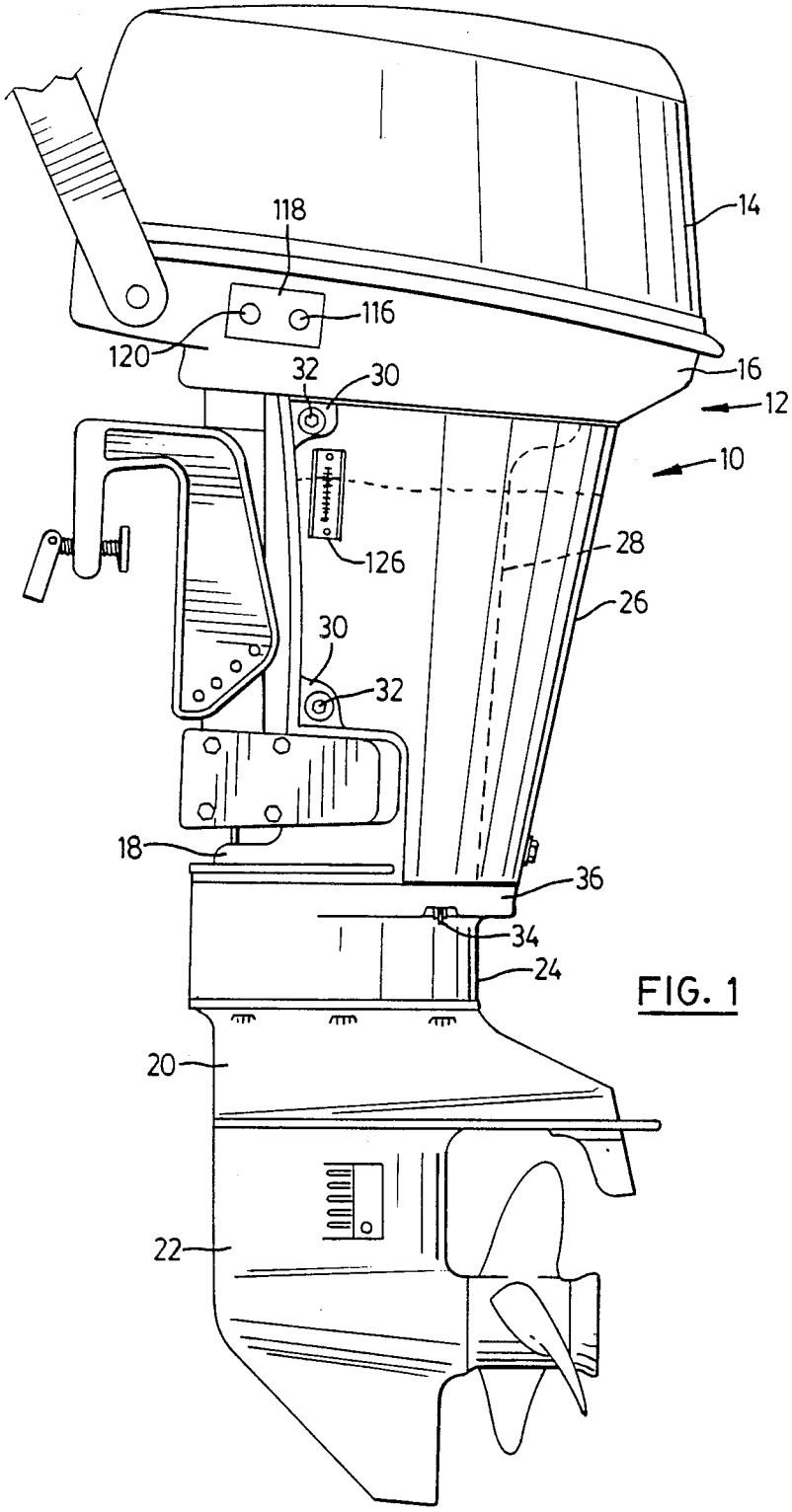
FIG. 1 is a side view of an outboard motor constructed in accordance with an embodiment of the present invention.

With reference to FIG. 1 of the drawings, the reference numeral 10 refers generally to an outboard motor constructed in accordance with an embodiment of the present invention. The outboard motor 10 has housing assembly generally identified by the reference numeral 12 which includes an upper engine cover 14, a lower engine cover 16, an exhaust leg section 18, a lower gear case 20 and a propeller housing 22, all of which are of conventional construction. A novel feature of the housing assembly is the provision of an extension housing 24 which is located between the exhaust leg section 18 and the lower gear case 20.

Figure 4:
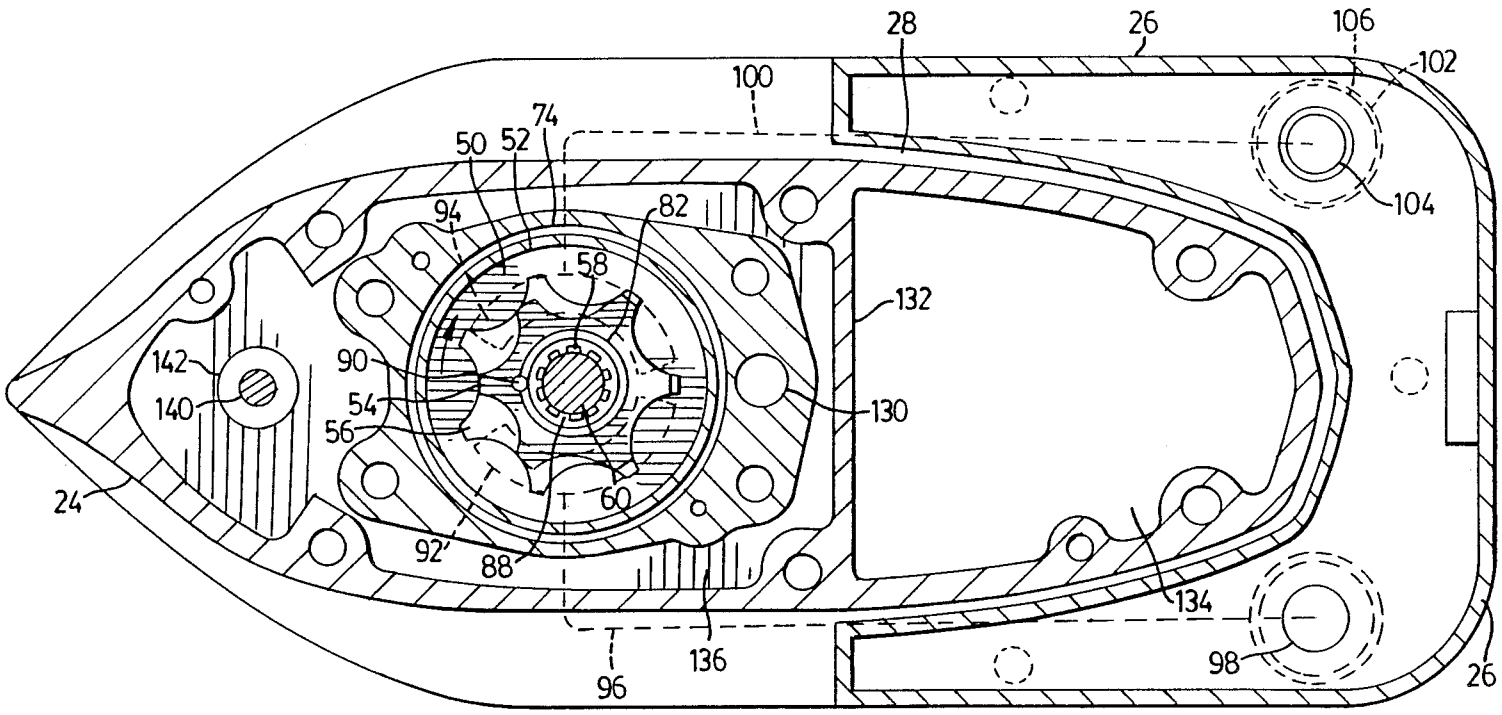
FIG. 4 is a sectional view taken through the exhaust leg of the motor assembly which illustrates the pump in plan view.

The extension housing 24 serves to accommodate a hydraulic pump as will be described hereinafter and also serves to provide for communication between the hydraulic pump and a hydraulic fluid storage tank 26 which is mounted on the exterior of the exhaust leg section 18. As shown in FIG. 4 of the drawings, the hydraulic fluid storage tank 26 has a generally U-shaped cross-sectional configuration which serves to provide a notch 28. This notch permits the fluid storage tank 26 to straddle the exhaust leg extension 18. Mounting lugs 30 are provided at the upper and lower corners of the front end of each leg of the storage tank and set screws 32 extend through the lugs 30 and serve to secure the storage tanks which respect to the exhaust leg. Mounting screws 34 extend through the flange 36 of the extension housing 24 and serves to secure the lower end of the fluid storage tank 26 with respect to the extension housing 24.

Figure 2:
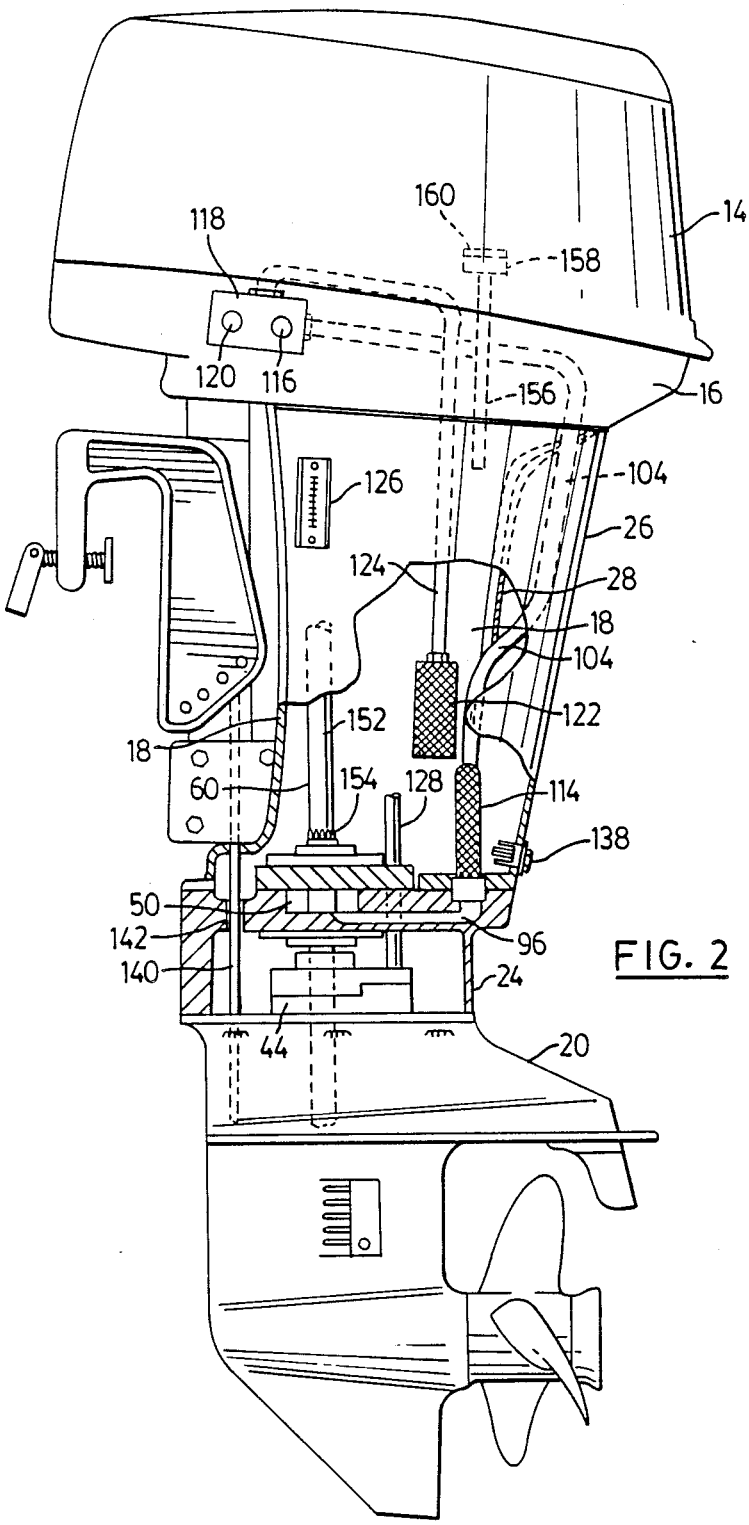
FIG. 2 is side view similar to FIG. 1 which is partially sectioned to illustrate interior components.
Figure 3:
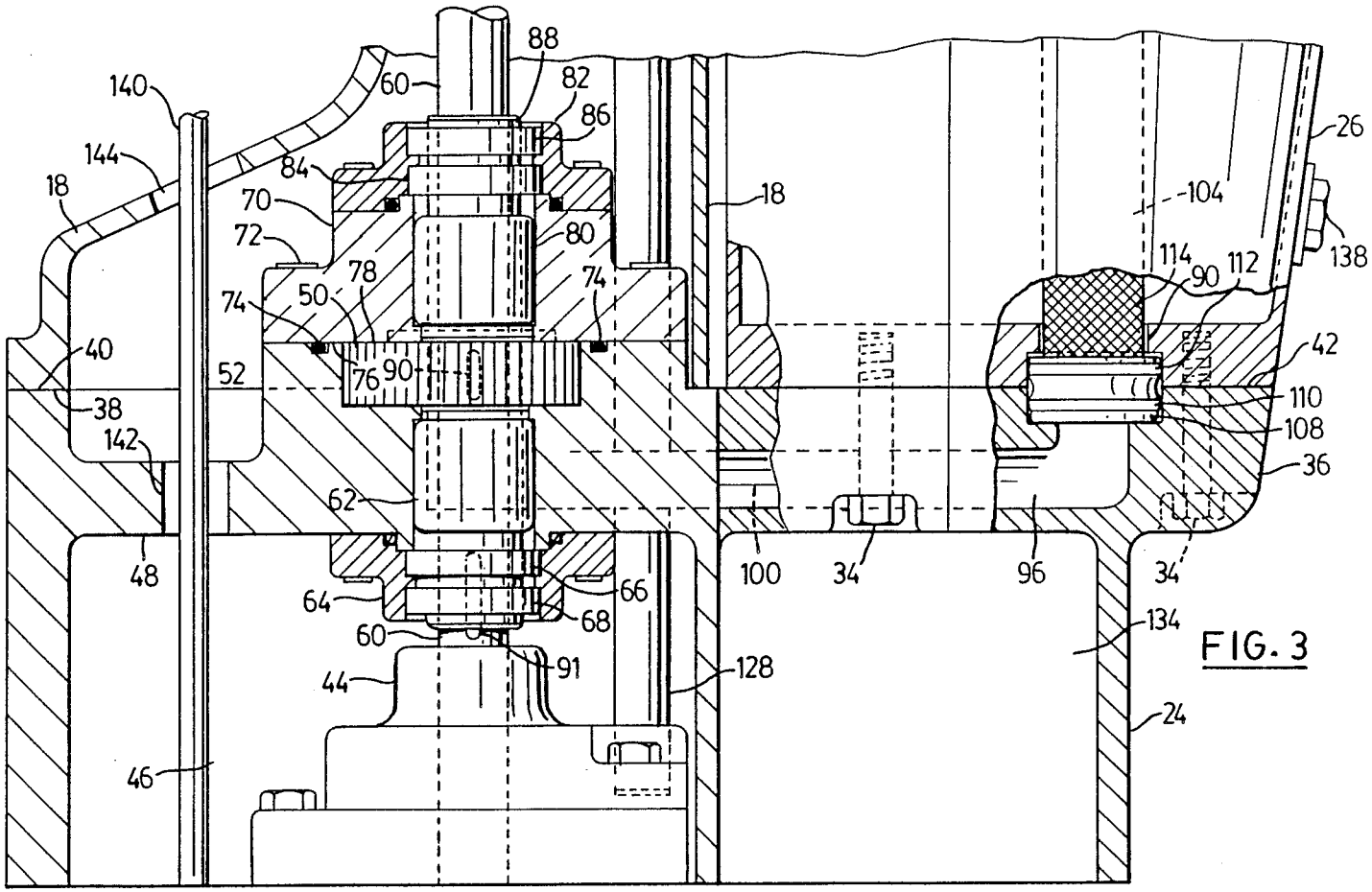
FIG. 3 is an enlarged sectional side view of the auxiliary housing which accommodates the hydraulic pump.

As shown in FIGS. 2 and 3 of the drawings, the extension housing 24 has an upper end face 38 which bears against the lower end face 40 of the exhaust leg extension and the lower end face 42 of the fluid storage tank 26.

A conventional water pump 44 is mounted on the upper end of the lower gear case 20 in a conventional manner. The water pump 44 extends into the chamber 46 which is formed within the extension housing 24.

The extension housing 24 has an upper wall 48 in which a recess 52 is provided which serves to accomodate a gear pump 50. The gear pump 50 has a rotor 54 which is mounted for rotation in the pump chamber 56. The rotor 54 has a through passage 58 formed therein through which the rotor drive shaft 88 extends. A key 90 serves to secure the rotor 54 to the rotor drive shaft 88. The rotor drive shaft 88 is mounted for rotation in a needle bearing 62 which is supported by the upper wall 48 of the extension housing 24. A sealing collar 64 is mounted on the underside of the upper wall 48 and serves to support a water sealing ring 68 and an oil sealing ring 66 in which the rotor drive shaft 88 is rotatably mounted.

A pump cover 70 is arranged to bear against the upper end of the upper wall 48 to close the pump chamber.

Cap screws 72 serve to secure the cover 70 to the wall of the pump. An O-ring 74 is clamped between the upper face 76 of the wall 48 and the lower face and the lower face of the pump cover 70.

A needle roller bearing 80 is mounted in the pump cover 70. A sealing collar 82 is mounted at the upper end of the pump cover 70. An oil sealing ring 84 and a water sealing ring 86 are mounted in the collar 82. The rotor drive shaft 88 of the gear pump 50 is mounted in the bearing 80 and extends through the seals 84 and 86. The rotor drive shaft 88 is a hollow shaft which has a through passage 58. A key 91 is provided to secure the rotor drive shaft 88 to the main drive shaft 60.

The rotor drive shaft 88 is connected to the rotor 54 by means of a key 90. The main drive shaft 60 extends through the passage 58 and the key 91 serves to connect the rotor drive shaft 88 and the main drive shaft 60 such that the hydraulic gear pump 50 can be rotatably driven from the main drive shaft 60.

The gear pump 50 has an inlet port 92 (FIG. 4) and an outlet port 94 which communicate with the pump chamber 56. Hydraulic fluid is supplied to the inlet port 92 through an input passage 96 which extends from the inlet port 92 to the outlet passage 98 of the hydraulic fluid storage tank 26. The hydraulic fluid outlet port 94 communicates with a hydraulic fluid supply passage 100 which is also formed in the upper wall 48 of the extension housing 24. The supply passage 100 communicates with a passage 102 which is formed in the hydraulic fluid storage tank 26. The supply conduit 104 has one end which is sealed in the passage 102 by means of a seal 106 which serves to permit hydraulic fluid under pressure to pass through the conduit 104 while being isolated from the hydraulic fluid storage chamber of the hydraulic fluid storage tank.

A similar seal 108 (FIG. 3) is used to seal the connection between the input passage 96 and the outlet passage 98. The seal 108 has a pair of 0-rings 110 and 112 located in opposite sides of the interface formed between the lower end face 38 and the upper end face 42. An oil filter 114 serves to filter the hydraulic fluid before it enters the input passage 96.

The supply conduit 104 is connected to a quick coupler nipple 116 of the hydraulic flow control relief valve assembly 118 which is mounted on the inside of the wall of the lower engine cover 16. A second quick coupler nipple 120 is mounted on the valve assembly 118 and communicates through the valve assembly 118 with the hydraulic fluid return conduit 124 which extends into the oil storage chamber of the oil storage tank and has an oil defuser 122 at its discharge end through which the returning oil is defused discharging into the storage tank.

The priority flow control valve assembly 118 incorporates an internal valving mechanism which serves to ensure that in circumstances where the nipples 116 and 120 are not operably connected to a hydraulically powered device, the hydraulic fluid which is supplied through the supply conduit 104 will be returned directly to the hydraulic fluid storage tank through the return conduit 124.

For the purposes of determining the level of hydraulic fluid in the hydraulic fluid storage tank 26, a site glass 126 is provided.

As previously indicated, the water pump 44 is a conventional water pump which has an outlet conduit 128 which extends through the passage 130 which is formed in the housing of the gear pump 50.

As shown in FIG. 4 of the drawings, the exhaust leg section 18 has a divider wall 132 which separates the exhaust compartment 134 from the compartment 136 in which the gear pump is accommodated.

It will be noted that the hydraulic fluid storage tank extends around the exhaust compartment 134 with the result that heat will be transferred from the exhaust leg extension to the storage tank 26 which will serve to maintain the hydraulic fluid at a working temperature even under conditions where the exterior of the hydraulic fluid storage tank is exposed to a cold, wet environment.

A drainage plug 138 (FIG. 2) is mounted in a passage which is located toward the lower end of the back wall of the storage tank. The drainage plug 138 can be removed to permit the hydraulic fluid to be drained from the hydraulic fluid storage tank.

A forward/reverse shift rod 140 extends through a passage 142 formed in the upper wall 48 and through a passage 144 formed in the exhaust leg section 18.

Figure 5:
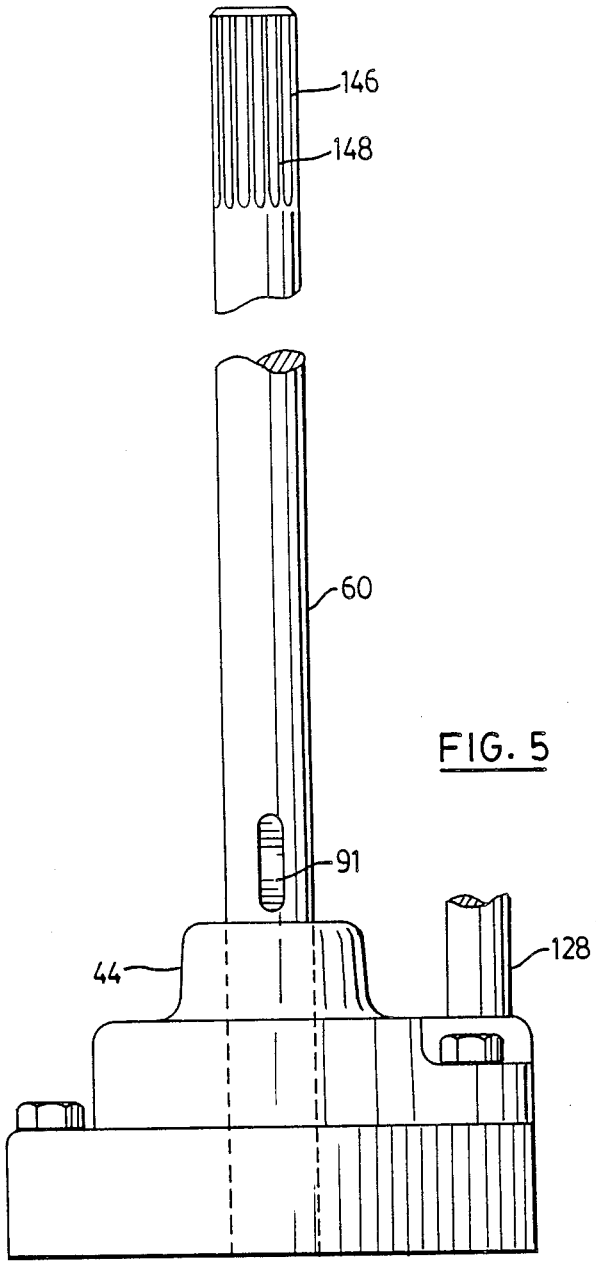
FIG. 5 is a side view of the main drive shaft of the outboard motor.

The main drive shaft 60 is more clearly illustrated in FIG. 5 of the drawings to which reference is now made. The main drive shaft 60 extends from the water pump 44 and is connected at its lower end (not shown) to the power transmission system of the propeller. The main drive shaft 60 has an upper end section 146 which is formed with a series of longitudinally elongated splines 148.

The key 91 is used to connect the main drive shaft 60 to the rotor drive shaft 88.

In use, when the engine of the outboard motor is running, it drives the main drive shaft 60. The main drive shaft 60 drives the gear pump 50 and the water pump 44. When the gear pump 50 is rotatably driven, hydraulic fluid is drawn from the hydraulic fluid storage tank 26 through the input passage 96 and inlet port 92 into the pumping chamber. The hydraulic fluid coupling means which serves to connect the hydraulic pump to a hydraulically driven device which is remote from the outboard motor assembly includes the output passage 98 of the nipple 116, the supply passage 100, the supply conduit 104 and the nipple 116, the coupling is completed by the nipple 120 and hydraulic fluid return conduit 124. When both of the quick coupling nipples 116 and 120 are connected to the device which is to be hydraulically driven, the hydraulic fluid will flow through the nipple 116 to the device which is to be driven and will return through the nipple 120 and conduit 124 to the hydraulic fluid storage tank. When the nipples 116 and 120 are disconnected from the hydraulically driven device, hydraulic fluid will pass directly from the supply conduit 104 to the return conduit 124.

A typical outboard motor which may be modified according to the present invention, is a 40 horsepower outboard motor such as a 40 horsepower MARINER® motor. In order to modify the motor, the lower gear case 20 is disconnected from the lower end of the exhaust leg section 18 to which it is normally attached. The standard exhaust leg is removed and is replaced with the shorter standard exhaust leg. The leg extension housing 24 with the gear pump mounted thereon is then mounted on the lower end of the leg extension and the lower gear case 20 is then mounted on the lower end of the extension housing 24.

A filing tube 156 is provided for use when filling the hydraulic fluid storage reservoir with hydraulic fluid. The filling tube 156 has an enlarged filling cup portion 158 at the upper end thereof which has a closure cap 160. The filling cup 158 and closure cup 160 extend into the engine compartment formed within the upper engine cover 14.

From the foregoing, it will be apparent that the present invention serves to provide a supplementary hydraulic power system which is driven directly from the main drive shaft of the outboard motor which can be accommodated as a simple modification to a standard outboard motor and which is contained within a modified housing assembly without requiring modification to the engine covers.

Figure 6:
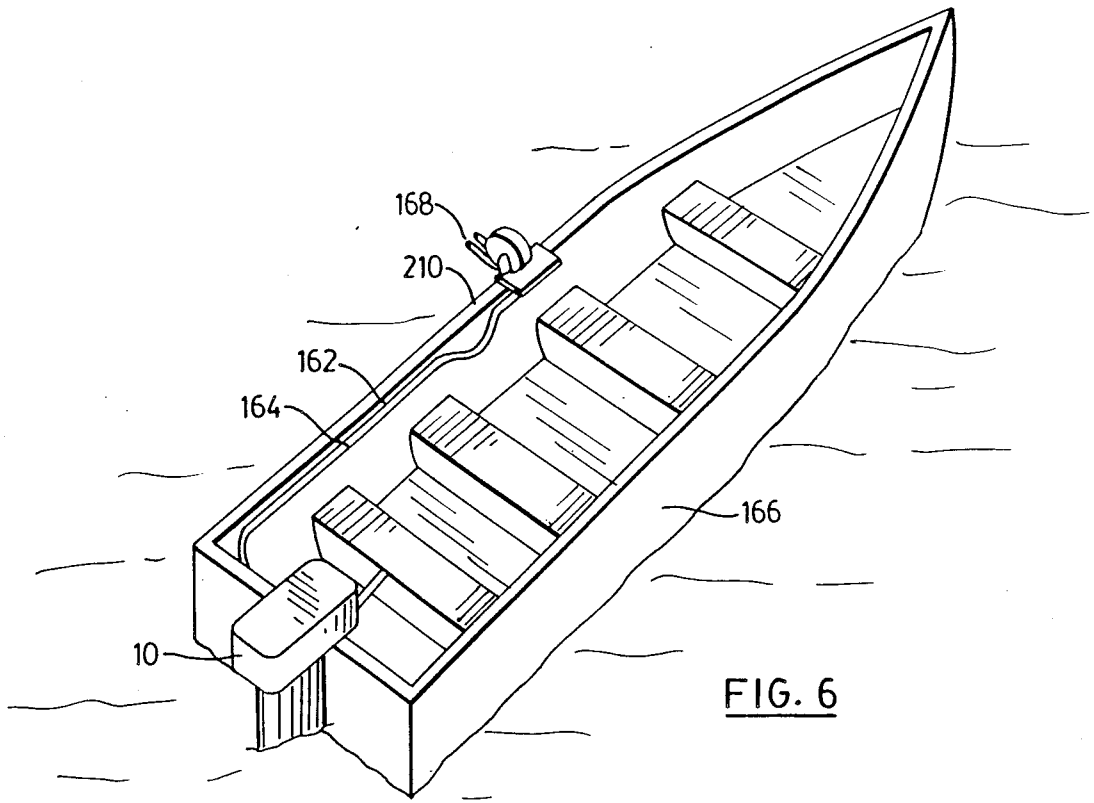
FIG. 6 is a pictorial view illustrating the outboard motor and a hydraulic winch mounted on a fishing boat.
Figure 7:
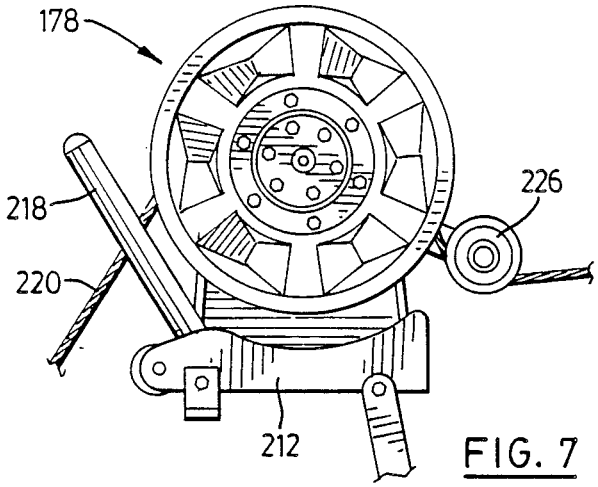
FIG. 7 is a side view of the winch of FIG. 6.
Figure 8:
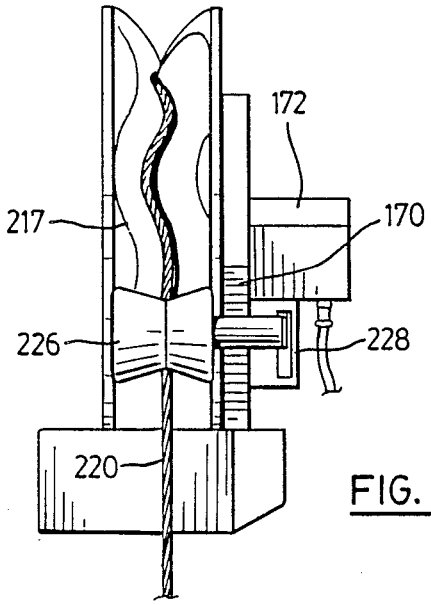
FIG. 8 is a front view of the winch of FIG. 7.
Figure 10:
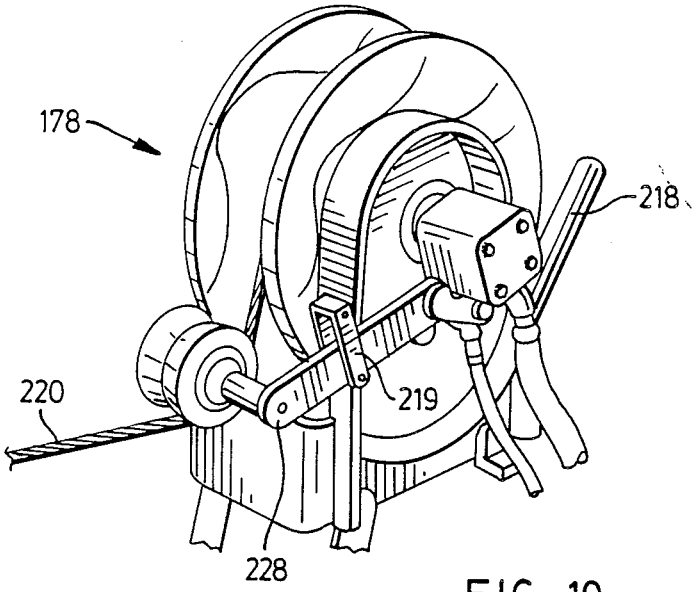
FIG. 10 is a pictorial front view of the winch of FIG. 7.

A typical use for the outboard motor assembly described above is illustrated in FIG. 6 of the drawings wherein hydraulic fluid lines 162 and 164 serve to connect the hydraulic fluid coupling means of the outboard motor 10 of a fishing boat 166 to a winch assembly 168 which may be used for hauling lobster pots or the like.

Powered winches have been used for hauling lobster pots, however, the previous devices have utilized a separate power source.

Figure 11:
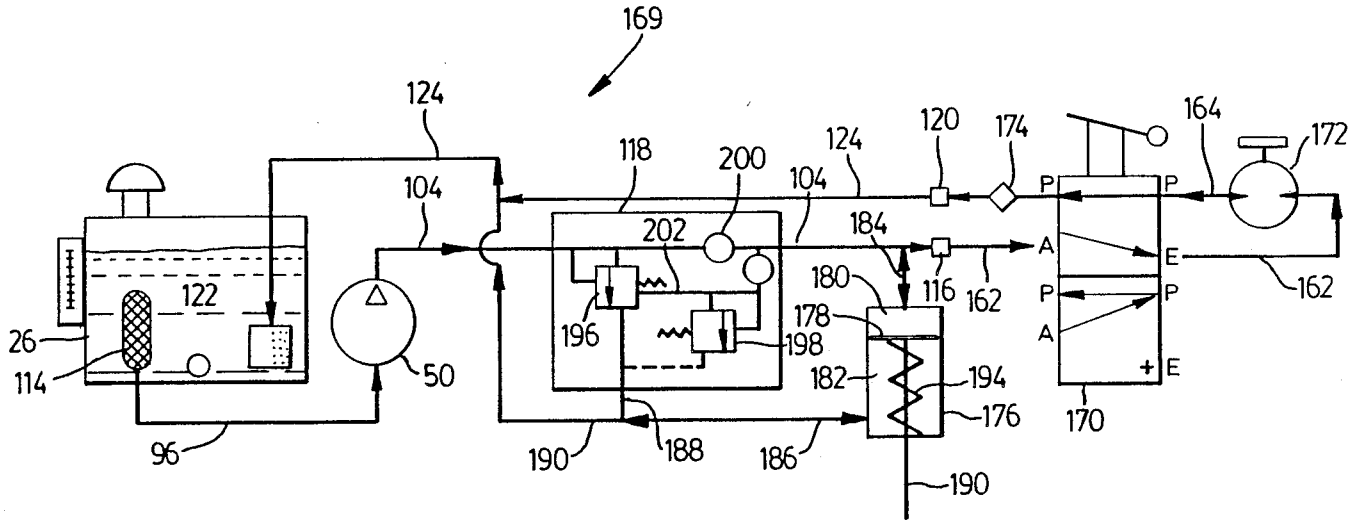
FIG. 11 is a diagramatic representation of the hydraulic circuit used to power the winch.

With reference to FIG. 11 of the drawings, the reference numeral 169 refers generally to the hydraulic power system for driving the hydraulic winch.

Figure 9:
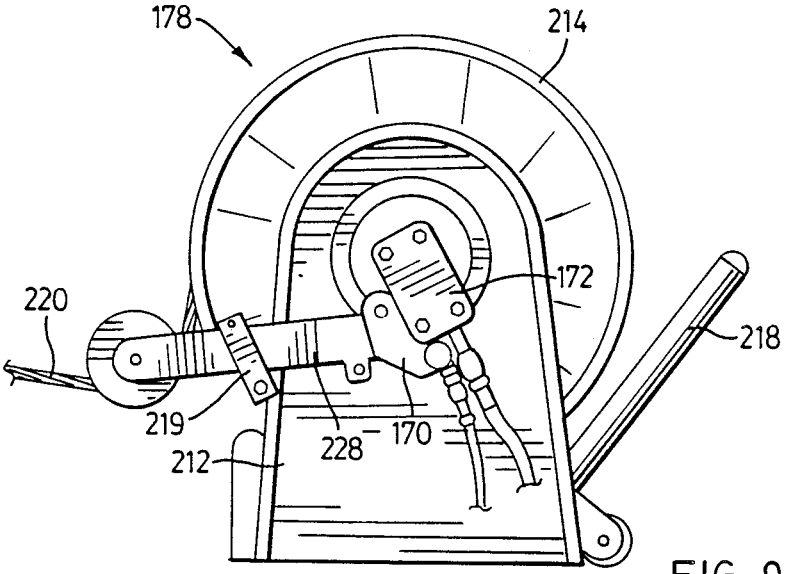
FIG. 9 is a side view of the opposite side of the winch of FIG. 7.

As shown in FIG. 11 of the drawings, the hydraulic fluid is drawn from the hydraulic fluid storage tank 26 through the output 96 which leads to the gear pump 50. The gear pump 50 is connected through the supply conduit 104 to the priority flow control valve 118. The hydraulic fluid then passes from the priority flow control valve 118 to the nipple 116. The hydraulic fluid passes from the nipple 116 through the conduit 162 to the selector valve 170. When the selector valve 170 is in the position shown in FIG. 9, the hydraulic fluid passes from the selector valve 170 to the hydraulic motor 172 of the winch assembly 168 and serves to drive the winch 168. The hydraulic fluid then returns through the conduit 164 to the selector valve 170 and from the selector valve 170 through the oil filter 174 to the nipple 120. The hydraulic fluid then returns to the hydraulic fluid storage tank 26 through the return conduit 124 and defuser 122. The selector valve 170 can be repositioned in order to bypass the hydraulic motor 172 and thereby deactivate the winch assembly 168. When the selector valve is repositioned, the hydraulic fluid from the line 162 is redirected so that it is returned through the return conduit 124 without passing through the motor 172.

A governor or throttle actuating device 176 has a piston 178 which divides the interior of the throttle activating cylinder into the chambers 180 and 182. The chamber 182 communicates with the supply conduit 104 upstream of the nipple 116 through a conduit 184. The compartment 182 is connected to a conduit 186 which has a branch line 188 which communicates with the flow control relief valve 118 and a further branch line 190 which communicates with the return conduit 124. The output shaft 192 of the throttle actuating device 176 is movable in response to movement of the piston 178. A return spring 194 serves to urge the piston 178 to a position which will serve to reduce the size of the compartment 180. The output shaft 192 is connected to the throttle of the engine of the outboard motor to control the speed of the motor to match the power requirements of the winch.

The priority flow control valve 118 has normally closed valves 196 and 198. When the hydraulic pressure in the supply conduit 104 exceeds a predetermined value, it will displace the valve 196 to permit hydraulic fluid to pass from the supply conduit 104 through the branch line 188 and branch line 190 to the return conduit 124. Similarly, when the pressure in the conduit 104 beyond the flow restrictor 200 exceeds a predetermined amount, the valve 198 will be deflected to bleed off some of the fluid from the line 104 to the branch line 188 and through the branch line 190 to the return conduit 104.

The winch assembly 168 is illustrated in FIGS. 7 to 10 of the drawings to which reference is now made. The winch assembly 178 is mounted on the gunnel 210 (FIG. 6) and includes a frame 212. The hydraulic motor 172 is mounted on the frame 212 and a line hauler pulley 214 is mounted on the output drive shaft of the motor 172 so as to be rotatably driven thereby in use. Vertical line guide rollers 218 are also mounted on the frame 212 and are arranged one on either side of the path of travel of the line 220. The line 220 extends under a line tension sensing roller 226. The roller 226 is mounted on a lever arm 228 which is normally biased toward the position shown in FIG. 10 and may be deflected to the position shown in FIG. 9 under the influence of the line 220. The arm 228 is connected to the hydraulic control valve 170 such that when the tension in the line 220 is sufficient to cause the arm 228 to be deflected toward the position shown in FIG. 9, the control valve 170 will supply hydraulic fluid to the motor 172 and when the arm 228 moves toward the position shown in FIG. 10, the control valve will stop the supply of hydraulic fluid to the motor 172. A bracket 229 serves to limit the movement of the arm 228.

The line hauler pulley has a line hauling groove 215 which extends in a tortuous serpentine path which substantially reduces the slippage which may occur between the pulley and the rope. The tortuous path results from a series of alternatly arranged crests 217 and valleys 219 which are formed on the inner face of each side wall of the pulley 214. The length of the root portion of the line hauling groove is preferably at least 50% greater than the circumference of the root portion.

As shown in FIG. 11, the hydraulic fluid is supplied to the motor 172 through a priority flow control valve 118, which is mounted inside of the lower engine cover (FIG. 1). The priority control valve 118 has a manually engageable control arm (not shown) which can be displaced in order to control the supply of hydraulic fluid to the winch to run at a speed selected by the fisherman.

Figure 12:
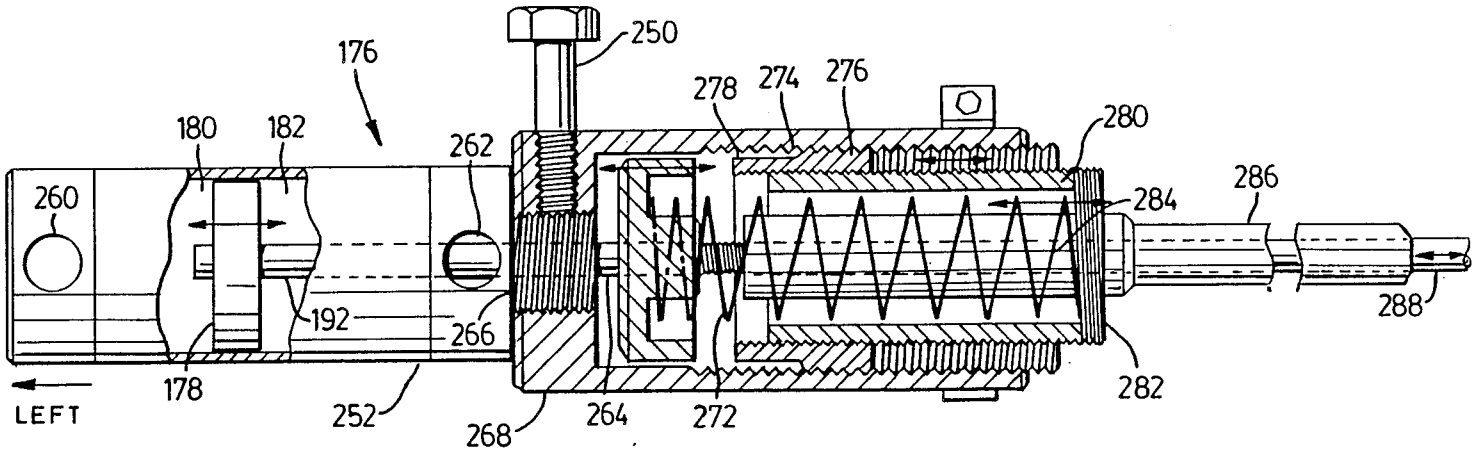
FIG. 12 is a partially sectioned side view of a governor which may be used in combination with the outboard motor and hydraulic powered system of the present invention.

As previously indicated in order to maintain the operating speed of the outboard motor when the winch is in operation, I provide a governor or throttle actuating device 176. The structure of a suitable governer is illustrated in FIG. 12 of the drawings and is generally identified by the reference numeral 176. The governor 176 includes a hydraulic cylinder 252 in which a piston 178 is slidably mounted. The piston 178 divides the cylinder 252 into chambers 180 and 182. A passage 260 opens into the chamber 180 and a passage 262 opens into the chamber 182. An output shaft 192 is connected to the piston 178. The cylinder 252 has a threaded end portion 266 which is mounted in a threaded passage in the governor housing 268. A piston 270 is threadedly mounted on a threaded portion 272 of the rod 264.

The governor housing 268 has a threaded bore 274 which opens inwardly from one end thereof. A threaded sleeve 276 is threadedly mounted in the bore 274. The threaded sleeve 276 can be moved along the bore 272 and the inner end 278 serves as a stop which limits the displacement of the piston 270. A further threaded sleeve 280 is threadedly mounted with the sleeve 276 and has an end wall 282 against which one end of a spring 194 is arranged to bear. The other end of the spring 194 bears against the piston 270. The spring 194 normally serves to urge the piston 270 away from the end wall 282. A throttle speed adjustment sleeve 286 is slidably mounted in a passage which is formed in the end wall 282. A throttle cable 288 is slidably mounted in the sleeve 286 and is connected at its inner end to the piston 270. A carburetor attachment stud 250 is mounted on the housing 268 and is connected to the butterfly valve of the carburetor of the engine of the outboard motor.

In use the oil pressure in the line 104 (FIG. 11) builds up as the load on the winch increases under load conditions. At a predetermined pressure the hydraulic fluid in the line 104 will pass through the line 184 into the chamber 180 and this will serve to displace the housing 268 to the left of the position shown in FIG. 12. Movement of the housing 268 causes movement of the carburetor attachment stud 250 which will serve to open the butterfly valve of the carburetor of the engine of the outboard motor to increase the supply of fuel to the outboard motor. This will serve to maintain engine speed when the winch is loaded.

The predetermined engine speed is set by adjusting the threaded sleeve 276 in relation to the piston 270.

From the foregoing it will be apparent that the present invention provides an outboard motor which has a power take-off which is simple and reliable in structure. The invention also provides a powered winch and a control system for use in association with the winch.

I claim:

1. In an outboard motor assembly of the type having a housing assembly which accomodates a motor, a propeller shaft and a power transmission system which includes main drive shaft which has a major portion of its length which extends between and drivingly connects the motor to the propeller shaft, the improvement wherein the outboard motor assembly further comprises;

(a) a hydraulic pump carried by the motor assembly and drivingly connected to the motor through the major portion of the main drive shaft so as to be operable to pump hydraulic fluid when the motor is running, (b) hydraulic fluid storage means carried by said housing assembly and having a fluid storage chamber formed therein, (c) hydraulic fluid coupling means for connecting the hydraulic pump to an hydraulically driven device which is remote from said outboard motor assembly, said coupling means being carried by said motor assembly and comprising; an output coupling member and a return coupling member, said output coupling member communicating with said pump to receive hydraulic fluid from said pump, said return coupling member communicating with said fluid storage chamber to return fluid to said storage chamber.

2. An outboard motor assembly as claimed in claim 1, wherein the housing assembly comprises an exhaust leg section and a lower gearcase, the further improvement of an extension housing mounted between the leg section and the lower gearcase, said pump being supported by the extension housing in alignment with said main drive shaft.

3. An outboard motor as claimed in claim 2, wherein the exhaust leg section has an exhaust chamber formed therein, a portion of said pump projecting into said chamber so as to be heated by the exhaust gases passing through in use.

4. An outboard motor assembly as claimed in claim 3, wherein the pump is also connected to the walls of the extension housing so as to be cooled by the exposure of the extension housing to the water in which the outboard motor assembly operates in use.

5. An outboard motor assembly as claimed in claim 2, wherein the storage tank means has a U-shaped cross-section in which the interior space between the legs of the U-shaped section is proportioned to accommodate the exhaust leg housing.

6. An outboard motor assembly as claimed in claim 1 wherein the housing assembly includes an exhaust leg housing member and the hydraulic fluid storage means comprises a storage tank means mounted on the exterior of the exhaust leg housing member in a direct heat exchange relationship therewith.

7. An outboard motor assembly as claimed in claim 1, wherein said coupling means comprises an output passage communicating with the output coupling member for connecting the output coupling member to an output of the hydraulic pump and a return passage communicating with the hydraulic fluid storage chamber, and bi-pass means which is operable to direct hydraulic fluid from the output passage directly to the return passage when the output and return coupling members are closed to prevent the passage of hydraulic fluid therethrough.

8. In a fishing boat which is powered by an outboard motor assembly which is mounted on the boat and which includes a motor which is operable to propel the boat, said motor assembly including an exhaust leg having the improvement of;

(a) an hydraulic pump carried by the motor assembly and drivingly connected to the motor, (b) a hydraulic fluid storage tank mounted on the exhaust leg, said storage tank having a hydraulic fluid storage chamber formed therein, said fluid storage chamber communicating with said hydraulic pump and said hydraulic motor to permit the pump to withdraw hydraulic fluid from said chamber and to permit the hydraulic motor to discharge hydraulic fluid into said chamber.

(c) a winch mounted on the boat at a point remote from the motor, (d) an hydraulic motor drivingly connected to said winch and operably connected to said hydraulic pump such that the winch may be driven by the motor of the outboard motor assembly.

9. A fishing boat as claimed in claim 8, wherein the storage tank means has a U-shaped cross-section in which the interior space between the legs of the U-shaped section is proportioned to accommodate the exhaust leg housing.

10. In an outboard motor assembly of the type having an exhaust leg which has an exhaust compartment through which exhaust fumes are exhausted from the motor and a second compartment which is separated from the exhaust compartment by a divider wall and through which a main drive shaft extends to a propeller shaft, the improvement comprising;

(a) an auxiliary hydraulic pump located within said second compartment, said auxiliary hydraulic pump being connected to the main drive shaft so as to be operable to pump hydraulic fluid when the motor is running said auxiliary hydraulic pump supplying hydraulic fluid to a power takeoff for use outside the motor.

11. An outboard motor assembly as claimed in claim 10 wherein the hydraulic fluid storage tank is located on the exterior of said exhaust leg and above the auxiliary hydraulic pump so as to establish a static pressure head in the hydraulic fluid supply which leads to the auxiliary hydraulic pump.

12. In an outboard motor assembly of the type having an auxiliary hydraulic pump drivingly connected to the motor and supplying hydraulic fluid to a hydraulic power take-off for use outside the motor and an exhaust leg through which exhaust fumes are exhausted from the motor the improvement comprising;

(a) a hydraulic fluid storage tank mounted on the exterior of the exhaust leg in a heat exchange relationship therewith whereby the hydraulic fluid storage tank is heated by the exhaust fumes in use, said storage tank communicating with the auxiliary hydraulic pump.

* * * * *